United States Patent [19]

Stedman

[11] 4,204,578

[45] May 27, 1980

[54] GROUND-ENGAGING IMPLEMENT ASSEMBLY

[75] Inventor: Robert N. Stedman, Chillicothe, Ill.

[73] Assignee: Caterpillar Tractor Co., Peoria, Ill.

[21] Appl. No.: 909,753

[22] Filed: May 26, 1978

[51] Int. Cl.[2] ..... A01B 13/08; A01B 63/102

[52] U.S. Cl. ..... 172/307; 172/484; 172/699

[58] Field of Search ..... 37/193; 172/297, 299, 172/300, 304, 301, 302, 306, 305, 307, 308, 309, 298, 273, 777, 292

[56] References Cited

U.S. PATENT DOCUMENTS

| | | | |
|---|---|---|---|
| Re. 23,895 | 11/1954 | Winget | 111/90 |
| 2,253,130 | 8/1941 | Lund | 172/305 X |
| 2,396,739 | 3/1946 | McCauley | 172/777 |
| 2,593,679 | 4/1952 | Kaupke | 172/292 |
| 2,754,740 | 7/1956 | Kirby | 172/297 |
| 3,457,660 | 7/1969 | Speno | 37/105 |
| 3,503,456 | 3/1970 | Larson | 172/484 |
| 3,893,516 | 7/1975 | Zimmerman | 172/273 |

FOREIGN PATENT DOCUMENTS

| | | | |
|---|---|---|---|
| 203608 | 10/1956 | Australia | 172/297 |
| 1006643 | 4/1957 | Fed. Rep. of Germany | 172/297 |

*Primary Examiner*—Richard J. Johnson

*Attorney, Agent, or Firm*—Charles E. Lanchantin, Jr.

[57] ABSTRACT

A ground-engaging implement assembly for installation on a vehicle includes a U-shaped frame having a bight portion extending around one end of the vehicle and a pair of spaced leg portions extending along and connected to the respective sides of the vehicle. Each of the leg portions of the frame has a mounting face thereon and an implement such as a ripper mechanism is connected to each mounting face for penetrating material at the opposite sides of the vehicle.

3 Claims, 2 Drawing Figures

GROUND-ENGAGING IMPLEMENT ASSEMBLY

BACKGROUND OF THE INVENTION

This invention relates to an improved ground-engaging implement assembly which is effective for penetrating material at the opposite sides of the vehicle on which it is mounted during longitudinal movement of the vehicle.

Conventional track-type tractors have long been equipped with auxiliary ripping mechanisms for penetrating and shattering earth, old roadbeds or the like. Heretofore, these ripping mechanisms have been primarily mounted on the rear wall of the tractor. An example thereof is disclosed in U.S. Pat. No. 3,503,456 issued to Donald J. Larson on Mar. 31, 1970.

While ripping mechanisms of the above-identified type have been widely accepted, the longitudinal location of the ripping mechanism is undesirable from the standpoint that the total weight of the tractor and ripping mechanism is not effectively used to drive the material penetrating element or elements into the earth. When the rearwardly located penetrating elements are lowered relative to the rear of the tractor, the rear of the tractor elevates and transfers a substantial portion of the total weight to the front of the ground-engaging members. The long longitudinal span between the support points reduces the penetrating capability of the ripping mechanism. Moreover, the tractor exhibits a tendency for increase lateral roll during forward movement because of the fact that the penetrating elements are usually located near the longitudinal center line.

Another problem is that the usual ripping mechanism is poorly located relative to the operator station. Consequently, the tractor operator often cannot visually observe the action of the tool during normal working conditions.

Still another desirable feature that the ground-engaging implement assembly should provide is an extended side reach in order to displace material laterally outside the tractor's perimeter.

SUMMARY OF THE INVENTION

The present invention is directed to overcoming one or more of the problems as set forth above.

According to the present invention this is accomplished by providing a ground-engaging implement assembly having a U-shaped frame having a bight portion extending around one end of a vehicle and a pair of spaced leg portions extending along and individually connected to the opposite sides of the vehicle. Each of the leg portions of the frame has a mounting portion thereon and a ground-engaging mechanism is connected to each mounting portion for displacing material at the opposite sides of the vehicle.

Advantageously, the present invention features a pair of ripper mechanisms with easily visually observable ripping elements which can effectively fracture compacted material at one or both sides of the vehicle during its forward movement. This is accomplished primarily by locating the ripper mechanisms substantially transversely adjacent the center of gravity of the vehicle.

Other advantages of the present invention will become more readily apparent upon reference to the accompanying drawings and the following description.

DETAILED DESCRIPTION

Figure 1:
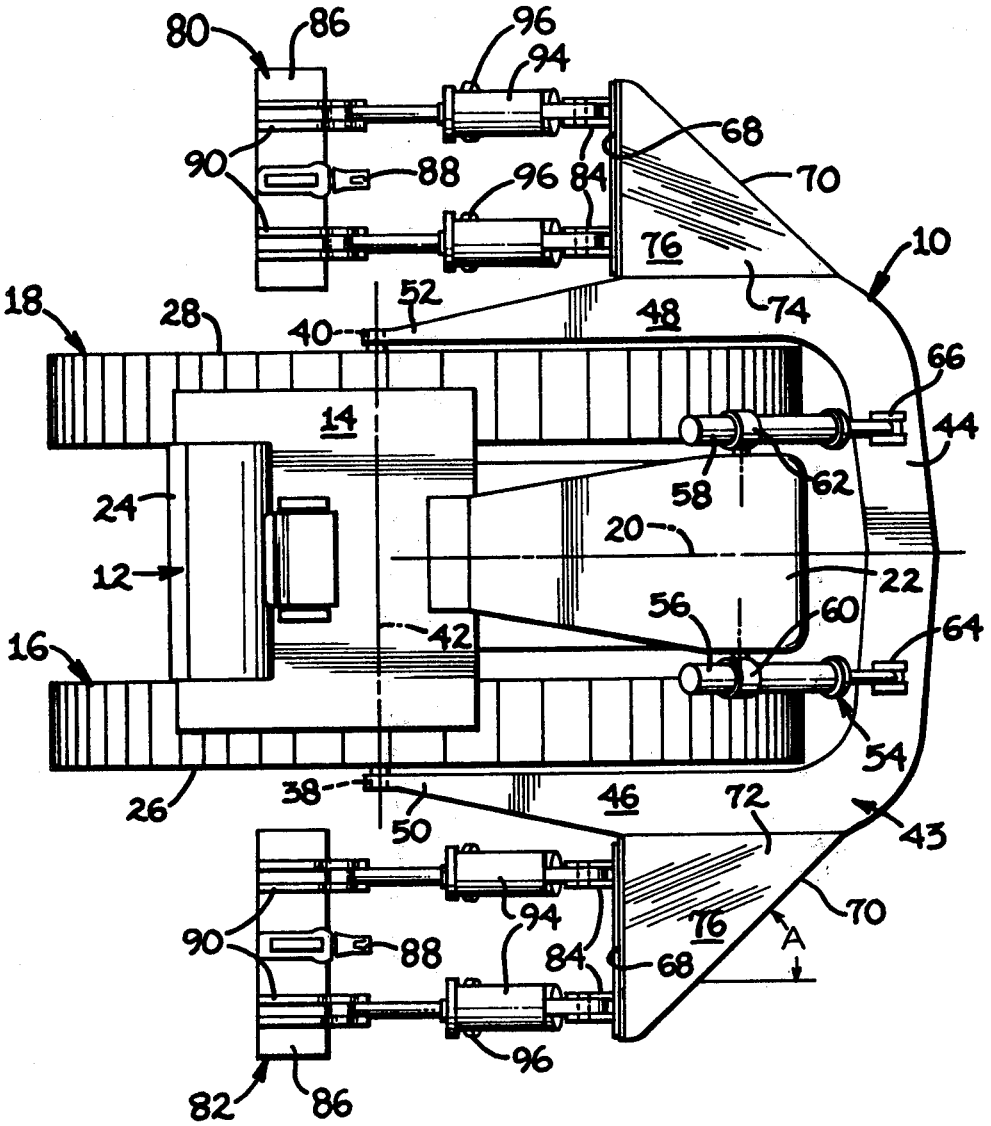
FIG. 1 is a diagrammatic top plan view of one embodiment of the ground-engaging implement assembly of the present invention as installed on a track-type tractor.

Referring to the drawings there is shown a ground-engaging implement assembly or ripper assembly 10 constructed in accordance with the present invention as installed on a conventional vehicle such as a track-type tractor 12, for example. The tractor has a central body 14 and a pair of opposite undercarriage assemblies 16 and 18 connected to and supporting the body and generally symmetrically arranged with respect to a central longitudinal axis 20. It being hereinafter understood that in the normal longitudinal direction of working movement the front portion of the tractor is located at the right when viewing the drawings, and the rear portion is located at the left. Accordingly, the tractor has a front end 22, a rear end 24, a right side 26, and a left side 28.

Each undercarriage assembly 16,18 is of the usual type, such as having an endless track chain 30, a plurality of roller wheels 32 mounted on a track roller frame 34 for supporting the chain, and a track driving sprocket 36 for driving the chain and propelling the vehicle. A pair of trunnions or pivot joints 38,40 are arranged on a common transverse pivot axis 42 normal to an upright longitudinal plane containing the central axis 20, and individually connected to the sides 26,28 of the respective undercarriage assemblies 16,18.

The ripper assembly 10 includes a U-shaped frame 43 having a bight portion 44 and a pair of spaced leg portions 46,48 disposed generally in a plane normal to the upright central longitudinal plane. The bight portion extends around the front end 22 of the tractor 12, and the leg portions extend rearwardly along the sides 26,28 and are individually connected at their distal ends 50,52 to the pivot joints 38,40.

The front end of the U-shaped frame 42 may be selectively raised and lowered relative to the tractor 12 by reciprocable means 54. More particularly, such means preferably includes a pair of lift actuators or hydraulic jacks 56,58 of selectively variable length which are connected to the front end 22 of the tractor 12 by universal support trunnions 60,62, and connected to the bight portion 44 of the frame at a pair of spaced joints 64,66. Thus, the frame 43 may be lowered by extension of the jacks 56,58 so that the frame pivots in a clockwise manner about the rear pivot axis 42, or alternately may be raised by retraction of the jacks.

Figure 2:
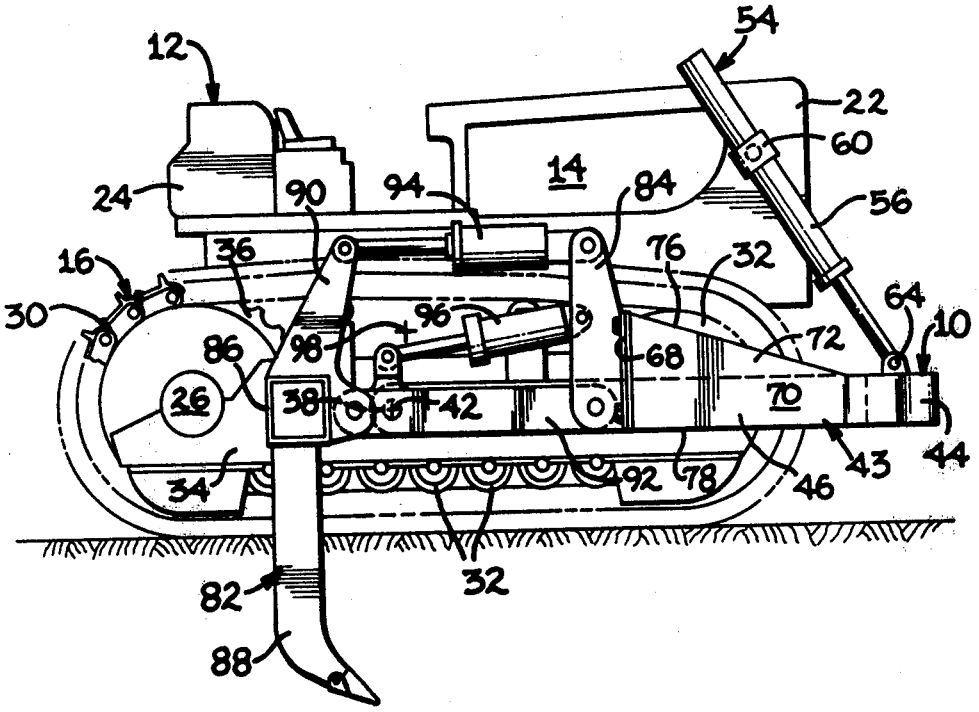
FIG. 2 is a diagrammatic side elevational view of the ground-engaging implement assembly and tractor illustrated in FIG. 1, with one ripper mechanism lowered into its material ripping mode of operation.

In accordance with a major aspect of the invention the U-shaped frame 43 has an upright, rearwardly facing, and substantially transversely oriented mounting portion or face 68 on each of the leg portions 46,48. Upright leading face means 70 located at laterally spaced locations on the bight portion 44 extends at a preselected inclination angle "A", as indicated in FIG. 1, from the central axis 20. Leading face means 70 not only serves to deflect material such as brush away from the central axis of the tractor 12 upon forward movement thereof, but forms with the mounting faces 68 a pair of opposite wing portions as indicated generally by the reference numerals 72 and 74 on the sides of the frame providing greater structural strength and rigidity to the ripper mounting portions. As is apparent when viewing FIG. 2, upper surface means 76 and lower surface means 78 of the wing portions taper divergingly rearwardly with respect to one another in order to provide additional structural support for and enlargement of the ripper mounting faces 68.

Advantageously, a pair of ground-engaging mechanisms or ripper mechanisms 80 and 82 of the usual type are releasably connected to the respective mounting faces 68 on the U-shaped frame 43. As shown best in FIG. 2, each ripper mechanism includes a spaced pair of upright mounting brackets 84 that form a forward part or arm of a parallelogram-type support linkage for controlling the relative position of a transverse cross beam 86 and a material penetrating element or ripper tooth 88 connected to the beam. A pair of upright beam brackets 90 are connected to the cross beam to form the rear part of the support linkage, and a pair of lower links 92 of fixed length are pivotally connected to the beam brackets and the mounting brackets to form the lower part of the support linkage. The upper part of the support linkage includes a pair of tilt actuators or jacks 94 of selectively varying length for controlling the angular disposition of the ripper tooth at a given depth. The depth of penetration of the ripper tooth 88 is controlled by the actuation of a pair of lift actuators or jacks 96 of selectively varying length individually connected at the front to the mounting brackets intermediate the upper and lower parts thereof and at the rear to either the links 92 as shown, or the beam brackets 90, not shown. For more specific details on the ripper mechanisms 80 and 82, attention is drawn to U.S. Pat. No. 3,503,456 mentioned heretofore, the subject matter of which is incorporated herein by way of reference.

In operation, the lift jacks 56 and 58 connected to the U-shaped frame 43 are retracted, and the lift jacks 96 of the individual ripper mechanisms 80 and 82 are retracted to raise the ripper teeth 88 out of the earth for traveling purposes of the tractor 12. Upon reaching the work location the lift jacks 56, 58 are extended to swing the frame 42 about the rear pivot axis 42 and to generally lower the front of the frame. Simultaneously, the lift jacks 96 of both ripper mechanisms are extended to lower the ripper teeth into the earth as the tractor progresses forwardly to commence ripping operations. Symmetrical loading of both of the ripper mechanisms by selectively lowering both ripper teeth 88 to the same approximate level of material penetration is preferred in order to better equalize transmission of the loads on the teeth into the force transmitting rear pivot joints 38,40 and to maintain movement of the tractor along a substantially straight longitudinal path without the need for steering correction. It is to be noted that the wrap-around construction of the U-shaped frame 43 tends to equalize the loads on the rear pivot joints, and that the rigid construction thereof in a substantially horizontal plane contributes to the transmission of force straight into these joints. At the same time it is to be noted that the lift jacks 56, 58 have a favorable mechanical advantage, and carry only a minimal portion of such forces.

It should be appreciated, however, that it is not a necessity to simultaneously operate both ripper mechanisms 80 and 82. For example, it might be desirable to rip material closely along the side of a wall, in which instance the tractor 12 is positioned so that one of the ripper mechanisms is located adjacent the wall. When the tractor is driven forwardly that ripper mechanism is lowered for shattering the material, the other ripper mechanism is elevated to an inoperative position, and any tendency of the tractor to turn towards the wall is overcome by selective steering corrections in a conventional manner.

While only a single example ripper mechanism is illustrated, it is contemplated that other forms of ripper mechanisms, land clearing blades and ground-engaging or penetrating implements may be connected to the U-shaped frame 43 at the two laterally spaced locations such as the mounting portions 68. Moreover, the number of earth penetrating teeth or work elements is not of primary significance. What is noteworthy is the longitudinal location of the mounting faces 68 laterally outwardly of the opposite sides 26,28 of the tractor, and the longitudinal location of the material penetrating elements relative to the center of gravity 98 of the total tractor and ripper assembly. Advantageously, the penetrating elements 88 are located in use substantially transversely adjacent the center of gravity 98. With such construction the entire weight of the machine is best utilized to cause maximum penetration of the elements. This is accomplished, in part, by locating the mounting faces 68 substantially centrally longitudinally between the pivot joints 38,40 and the bight portion 44.

In marked contrast, conventional ripping elements are located on ripper mechanisms mounted on the rear of the vehicle where only a smaller proportion of the machines total weight can be effectvely utilized. As a result, the prior art ripper teeth have often failed completely to penetrate extremely hard earth, shale or the like. On the other hand, the instant ripper assembly 10 offers the rugged capability to penetrate such hard material.

Other aspects, objects and advantages will become apparent from a study of the specification, drawings and appended claims.

The embodiments of the invention in which an exclusive property or privilege is claimed are defined as follows:

1. A ground-engaging implement assembly (10), for installation on a vehicle (12) having first and second ends (22,24), first and second sides (26,28), and a longitudinal axis (20), comprising:

a pair of transversely aligned pivot joints (38,40) connected to the sides (26,28) of the vehicle (12);

a U-shaped frame (43) having a bight portion (44) and a pair of spaced leg portions (46,48) individually having a distal end (50,52), said bight portion (44) extending around one of said vehicle ends (22,24) and said leg portions (46,48) extending along said sides (26,28) and being connected individually to said pivot joints (38,40) at the distal ends (50,52), each of said leg portions (46,48) having a wing portion (72,74) defining an upright, substantially transversely oriented mounting face (68) located longitudinally between said pivot joints (38,40) and said bight portion (44); and two mechanisms (80,82), each mechanism (80,82) having a material penetrating element (88) and jack means (96) for selectively and hydraulically raising and lowering said element (88), and each mechanism (80,82) being connected to a respective one of said mounting faces (68) at the opposite sides (26,28) of the vehicle (12).

2. The ground-engaging implement assembly (10) of claim 1 wherein said vehicle (12) is a crawler tractor having a longitudinal axis (20) and a center of gravity (98), and said material penetrating elements (88) are located in use substantially transversely adjacent said center of gravity (98).

3. In a crawler tractor (12) of the type having a front end (22), left and right undercarriage assemblies (16,18) having outer sides (26,28) and a pivot joint (38,40) at each of the outer sides (26,28), a ground-engaging implement assembly (10) comprising:

a U-shaped frame (43) extending around the front end (22) of the tractor (12) and along the outer sides (26,28) and being connected to the pivot joints (38,40), the frame (43) having wing portions (72,74) defining left and right, rearwardly facing, upright mounting faces (68) located longitudinally between the pivot joints (38,40) and the front end (22) of the tractor (12) and extending laterally outwardly away from the undercarriage assemblies (16,18); and a ripper mechanism (80,82) connected to each of said mounting faces (68) and having a material penetrating element (88) located in use substantially tranversely of the center of gravity of the crawler tractor (12).

* * * * *